US007393457B2

(12) United States Patent
Kao et al.

(10) Patent No.: US 7,393,457 B2
(45) Date of Patent: Jul. 1, 2008

(54) METHOD FOR MAKING A SHADOW MASK FOR AN OPPOSED DISCHARGE PLASMA DISPLAY PANEL

(75) Inventors: Hsu-Pin Kao, Pingjhen (TW); Jang-Jeng Liang, Taoyaun (TW); Sheng-Wen Hsu, Taipei (TW); Hsu-Chia Kao, Pingjhen (TW)

(73) Assignee: Marketech International Corporation, Taipei (TW)

( * ) Notice: Subject to any disclaimer, the term of this patent is extended or adjusted under 35 U.S.C. 154(b) by 125 days.

(21) Appl. No.: 11/521,364

(22) Filed: Sep. 15, 2006

(65) Prior Publication Data

US 2007/0117241 A1 May 24, 2007

(30) Foreign Application Priority Data

Nov. 22, 2005 (TW) ..... 94140918 A

(51) Int. Cl.
*B44C 1/22* (2006.01)

(52) U.S. Cl. ..... 216/12; 216/17; 216/52; 216/75

(58) Field of Classification Search ..... 216/12, 216/17, 52, 54, 75
See application file for complete search history.

(56) References Cited

U.S. PATENT DOCUMENTS

2005/0093202 A1* 5/2005 Yokoyama et al. ..... 264/224
2005/0191783 A1* 9/2005 Toyoda et al. ..... 438/34
2005/0231098 A1* 10/2005 Chen et al. ..... 313/495
2006/0049756 A1* 3/2006 Kim ..... 313/582
2006/0121815 A1* 6/2006 Kim et al. ..... 445/24
2006/0225463 A1* 10/2006 Sugimoto et al. ..... 65/31

* cited by examiner

*Primary Examiner*—Binh X Tran
(74) *Attorney, Agent, or Firm*—Bacon & Thomas, P.L.L.C.

(57) ABSTRACT

The present invention is to provide a method for making a shadow mask for an opposed discharge plasma display panel by etching one lateral surface of a metal slab to produce a plurality of parallel and equidistant barrier ribs along the vertical and horizontal directions on the lateral surface and a discharging cell by enclosing every four adjacent barrier ribs. A shadow hole is formed at the middle of each discharging cell and etched through the metal slab, and at least one groove interconnected to the shadow holes is produced on another lateral surface of the metal slab by utilizing a rolling process or a stamping process. The adjacent grooves are interconnected with each other, and a plurality of air guide channels is formed on another lateral side, such that a shadow mask can be made in a simple and fast manner, chemical pollutions caused by a traditional double-sided etching can be minimized, and the product yield rate and the manufacturing cost can be effectively improved and lowered.

6 Claims, 7 Drawing Sheets

METHOD FOR MAKING A SHADOW MASK FOR AN OPPOSED DISCHARGE PLASMA DISPLAY PANEL

FIELD OF THE INVENTION

The present invention relates to a method for making a shadow mask for an opposed discharge plasma display panel, and more particularly to a method for making a shadow mask for an opposed discharge plasma display panel by utilizing a machining process, instead of a traditional double-sided etching process, to form a plurality of air guide channels in a simple and fast way on one side of the shadow mask needed for manufacturing the opposed discharge plasma display panel.

BACKGROUND OF THE INVENTION

Referring to FIG. 1 for the manufacturing technology of a traditional opposite discharge AC type (AC) plasma display panel (PDP) 10, different functional layers are formed on two glass substrates 11, 12, and the peripheries of the two glass substrates are sealed o form a space between the two glass substrates, and a special gas mixed according to a specific proportion such as helium (He), neon (Ne), xenon (Xe) or argon (Ar), etc is filled in the discharging cell 13 within the space between the two glass substrates. In the structure of a plasma display panel as shown in FIG. 1, the substrate facing the viewer is a front substrate 11, and the front substrate 11 at its inner side sequentially includes a plurality of parallel transparent electrodes 111, auxiliary electrodes (or bus electrodes) 112, dielectric layers 113, and protective layers (such as manganese oxide, MgO) 114, and the corresponding rear substrate 12 sequentially includes a plurality of parallel data electrodes 121, dielectric layers 124, protective layers 125, barrier ribs 122, and evenly coated phosphors 123 (which could be red, green, or blue phosphors), such that if a voltage is applied to the electrodes 111, 112, 121 at related positions, the dielectric layers 113, 124 at the corresponding positions will discharge electricity in the corresponding discharging cells 13 formed between the adjacent barrier ribs 122, enabling the phosphors 123 to emit the corresponding color lights.

In the AC discharge plasma display panel 10 as shown in FIGS. 1 and 2, the electrodes on the front substrate 11 generally go through spluttering and photolithography to form a plurality of mutually isolated and horizontally aligned transparent electrodes 111 on the inner surface of the front substrate 11, and then go through deposition (or spluttering) and photolithography or printing process to form the bus electrode 112 on the transparent electrode 111, such that the bus electrode 112 reduces the line impedance of the transparent electrode 111. The transparent electrode 111 (including bus electrode 112) and the data electrode 121 disposed at corresponding positions of the rear substrate 12 form two opposed electrodes, so that if a voltage is applied to these electrodes 111, 121, their dielectric layers 113, 124 in the corresponding discharging cells 13 will carry out opposed discharges, and the mixed gas therein will discharge electricity to produce an ultraviolet (UV) light and activate the phosphors 123 coated on the discharging cell 13 to emit three visible lights: red, green, and blue and display images. The traditional AC discharge plasma display panel 10 of this sort is also known as "opposite discharge plasma display panel".

In the foregoing opposite discharge plasma display panel 10 as shown in FIGS. 1 and 2, the data electrode 121 on the rear substrate 12 is disposed at the bottom of the dielectric layer 124 and parallel to the corresponding transparent electrode 111 (also called "scan electrode" or "sustain electrode") disposed on the front substrate 11 and vertically coupled to the position of each discharging cell 13. A shadow mask 20 is attached onto the protective layer 125 at the top of the dielectric layer 124, and the space corresponding to each shadow hole 21 on the shadow mask. 20 forms each discharging cell 13, and the metal conductor around each shadow hole 21 serves as a barrier rib 122 for each discharging cell 13 and is formed by enclosing the adjacent barrier ribs 122 in the corresponding discharging cell 13. The phosphor 123 is coated evenly onto the wall of the grid barrier rib 122, and the coating area of the phosphor 123 is increased to effectively improve the luminescence efficiency of the plasma display panel 10. However, the rear substrate 12 of the foregoing opposite discharge plasma display panel 10 is attached to the barrier rib 122 that is formed by the grid metal conductors disposed around each shadow hole 21 of the shadow mask 20, such that after the front substrate 11 is attached on another side of the shadow mask 20, and the peripheries of the two glass substrates 11, 12 are sealed, each discharging cell 13 will not discharge or fill air easily due to the grid design of the barrier rib 122.

To improve the efficiency of discharging and filling air, the traditional shadow mask 20 adopts a double-sided etching method as shown in FIG. 3 to etch the required barrier ribs 122 and shadow holes 21 on one side of the shadow mask 20 and a plurality of air channels 23 on the other side of the shadow mask 20 and at the positions corresponding to the shadow holes 21 as shown in FIG. 4. Each air channel 23 is interconnected to the discharging cell 13 through the shadow hole 21 for effectively solving the air discharging and filling problem of the discharging cell. However, this method still has the following shortcomings:

(1) In the double-sided etching method, the process of etching the barrier ribs 122 and the air channels 23 on both sides of the shadow mask 20 is quite complicated, and the level of difficulty is relatively high, and thus incurring a higher manufacturing cost.

(2) In the double-sided etching method for making the shadow mask 20, it is not easy to control the width and depth of the air channel 23 in the etching process as shown in FIG. 5. To ensure that the etched air channel 23 will not affect the size of the shadow hole 21, the etching depth of the discharging cell 13 is generally reduced to increase the remaining thickness tm of the shadow mask 20 for etching and producing the air channel 23. However, if the etching depth of the discharging cell 13 in this method is decreased, the coating area of the phosphor will become less, and thus causing an adverse effect to the luminescence efficiency of the opposite discharge plasma display panel.

SUMMARY OF THE INVENTION

In view of the shortcomings of the prior art double-sided etching method, such as a high production cost and a poor luminescence efficiency due to the barrier ribs and air channels being etched on both sides of the shadow mask of the opposite discharge plasma display panel, the inventor of the present invention based on years of experience to conduct extensive researches, and finally invented a method of making a shadow mask for an opposite discharge plasma display panel.

Therefore, it is a primary objective of the present invention is to etch a plurality of parallel and equidistant barrier ribs along the vertical and horizontal directions and on a side of a metal slab by an etching process, and form a discharging cell by enclosing every four adjacent barrier ribs. A shadow hole is disposed at the middle of each discharging cell and etched through the metal slab, and at least one groove interconnected to the shadow hole is produced on another side of the metal slab and at a position corresponding to each discharging cell by a machining process. The adjacent grooves are interconnected with each other, and a plurality of air guide channels is formed on another side, such that a shadow mask required for the opposite discharge plasma display panel can be made in a simple and fast manner. In addition to minimizing chemical pollutions caused by the traditional double-sided etching, the present invention also can effectively improve the product yield rate and lower the manufacturing cost.

Another objective of the present invention is to adopt a single-sided etching process to produce the required barrier ribs, discharging cells, and shadow holes on a lateral surface of the shadow mask, and the other lateral surface of the shadow mask is rolled or stamped along the horizontal direction, vertical direction, aslant direction, or two-dimensional interlacing direction by a rolling process or a stamping process at the position corresponding to each discharging cell to produce a groove interconnected to the shadow hole, such that the adjacent grooves are interconnected with each other to form a plurality of air guide channels for greatly enhancing the air discharging and filling efficiency of the discharging cell and accurately control the width and depth of the air channel, so as to increase the etching depth of the discharging cell and the coating area of the phosphor and effectively enhance the luminescence efficiency of the opposite discharge plasma display panel.

The above and other objects, features and advantages of the present invention will become apparent from the following detailed description taken with the accompanying drawings.

DETAILED DESCRIPTION OF THE PREFERRED EMBODIMENTS

Figure 1:
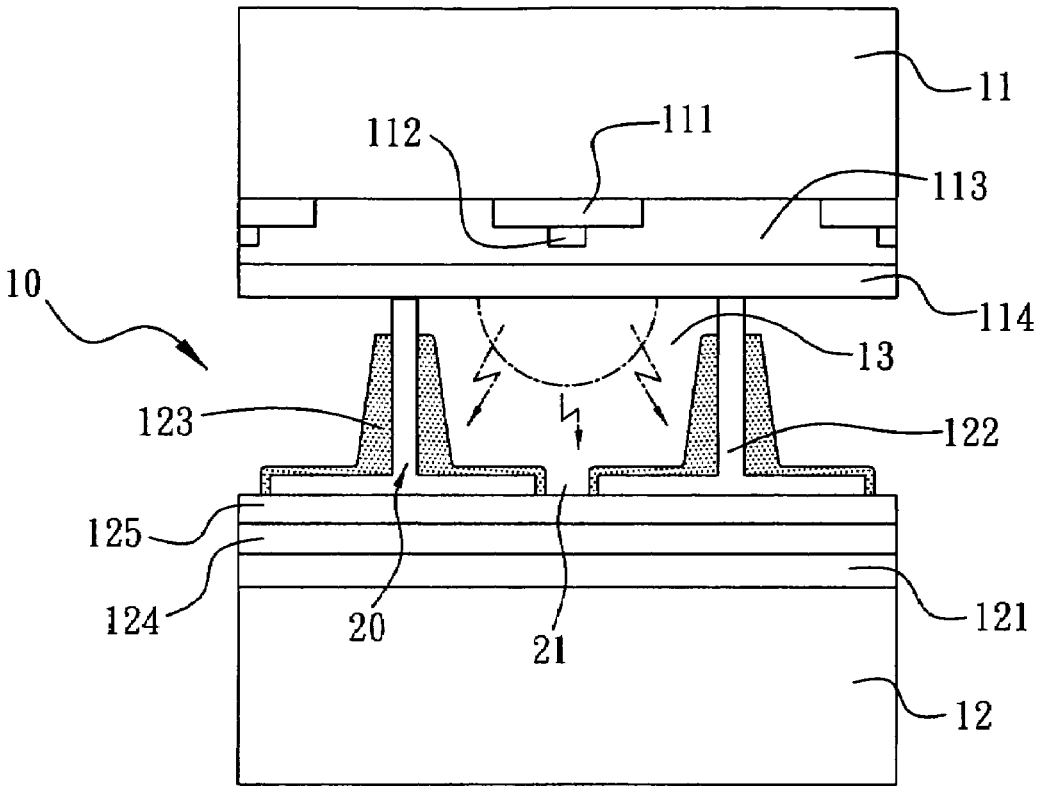
FIG. 1 (Prior Art)
FIG. 1 is a schematic cross-sectional view of a prior art plasma display panel.
Figure 2:
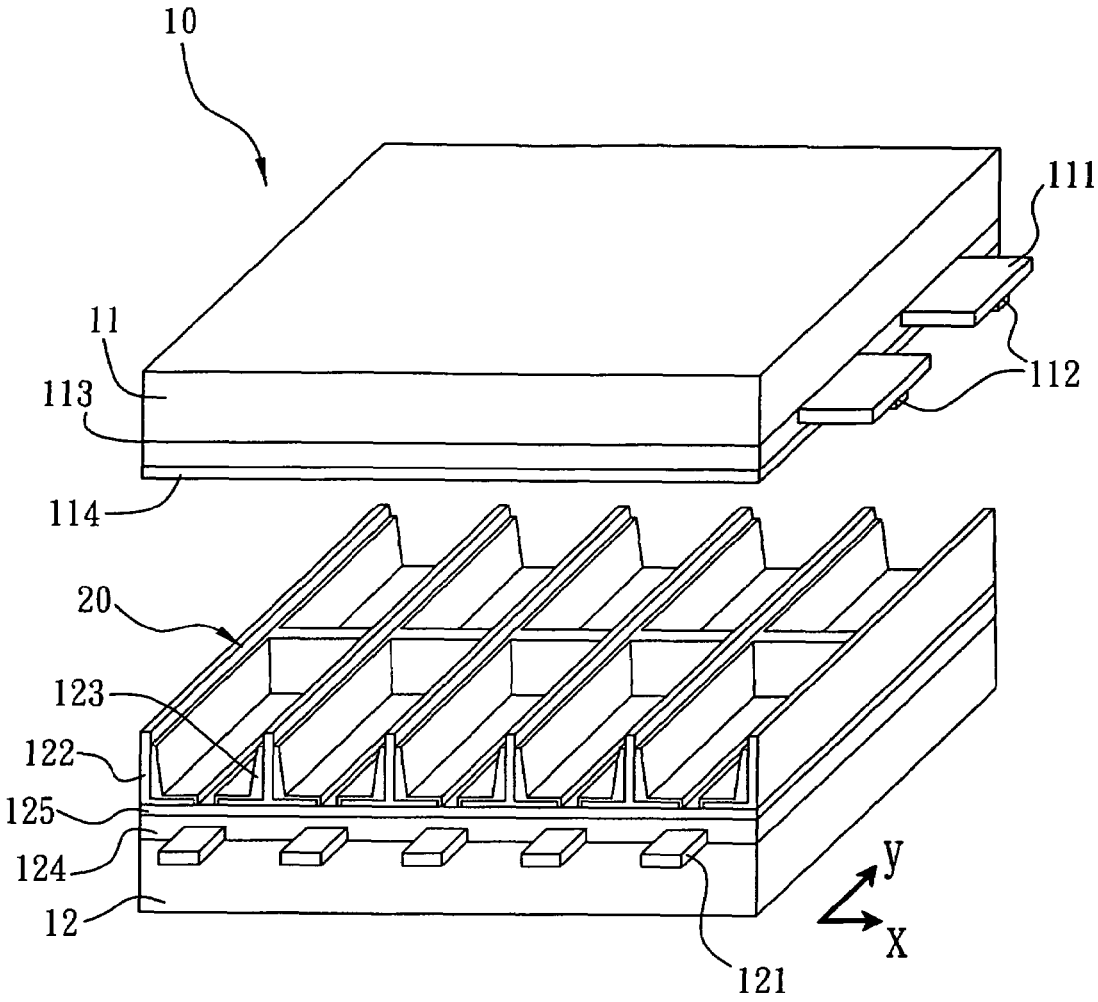
FIG. 2 (Prior Art)
FIG. 2 is a schematic view of assembling a front substrate and a rear substrate of a prior art opposite discharge plasma display panel.
Figure 3:
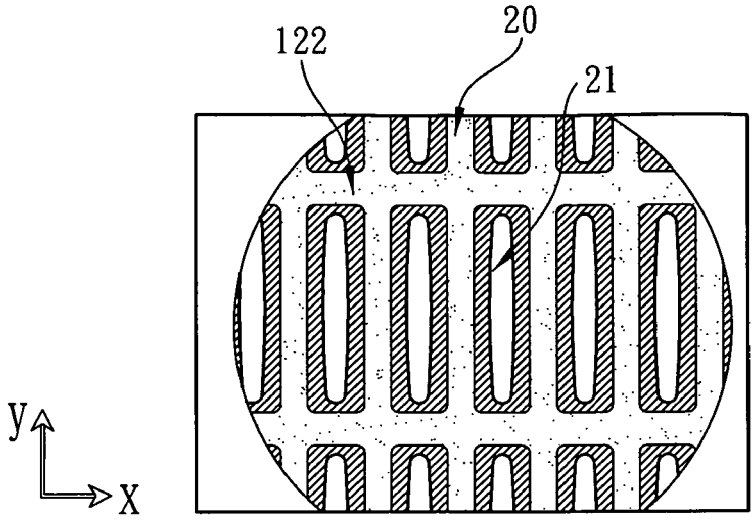
FIG. 3 (Prior Art)
FIG. 3 is a picture showing a portion of the front enlarged view of a shadow mask of a prior art opposite discharge plasma display panel.
Figure 4:
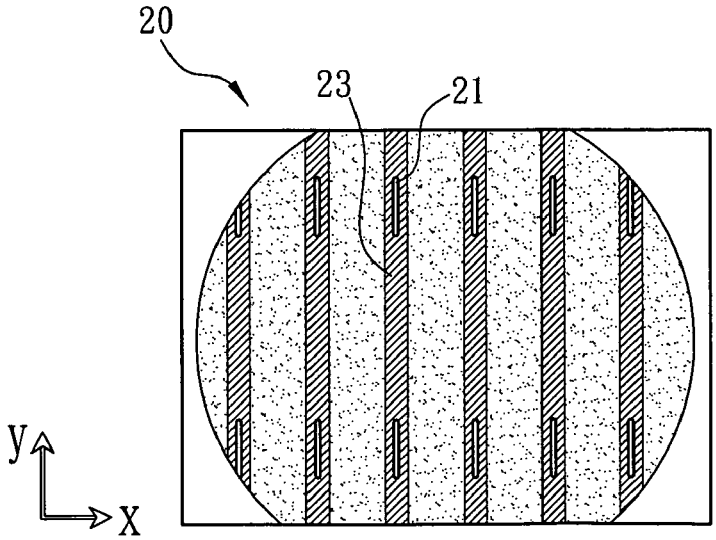
FIG. 4 (Prior Art)
FIG. 4 is a picture showing a portion of the rear enlarged view of a shadow mask of a prior art opposite discharge plasma display panel.
Figure 5:
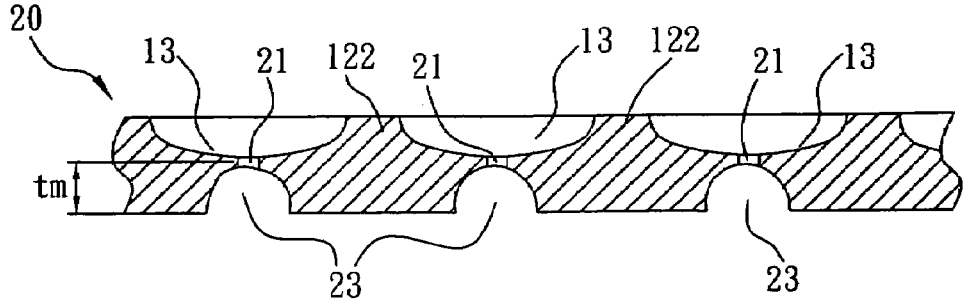
FIG. 5 (Prior Art)
FIG. 5 is a schematic cross-sectional view of a shadow mask of a prior art opposite discharge plasma display panel.
Figure 6:
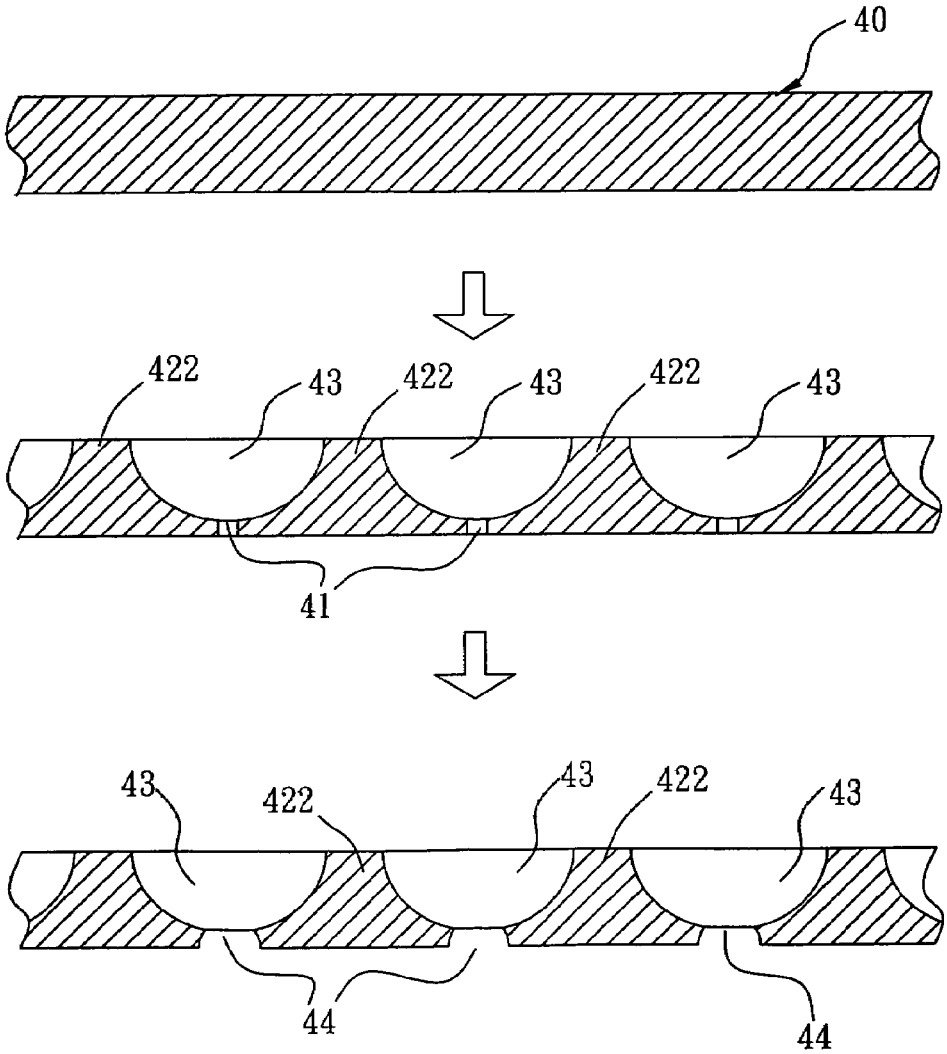
FIG. 6 is a schematic cross-sectional view of the change of a portion of a shadow mask according to the machining process of the present invention.
Figure 7:
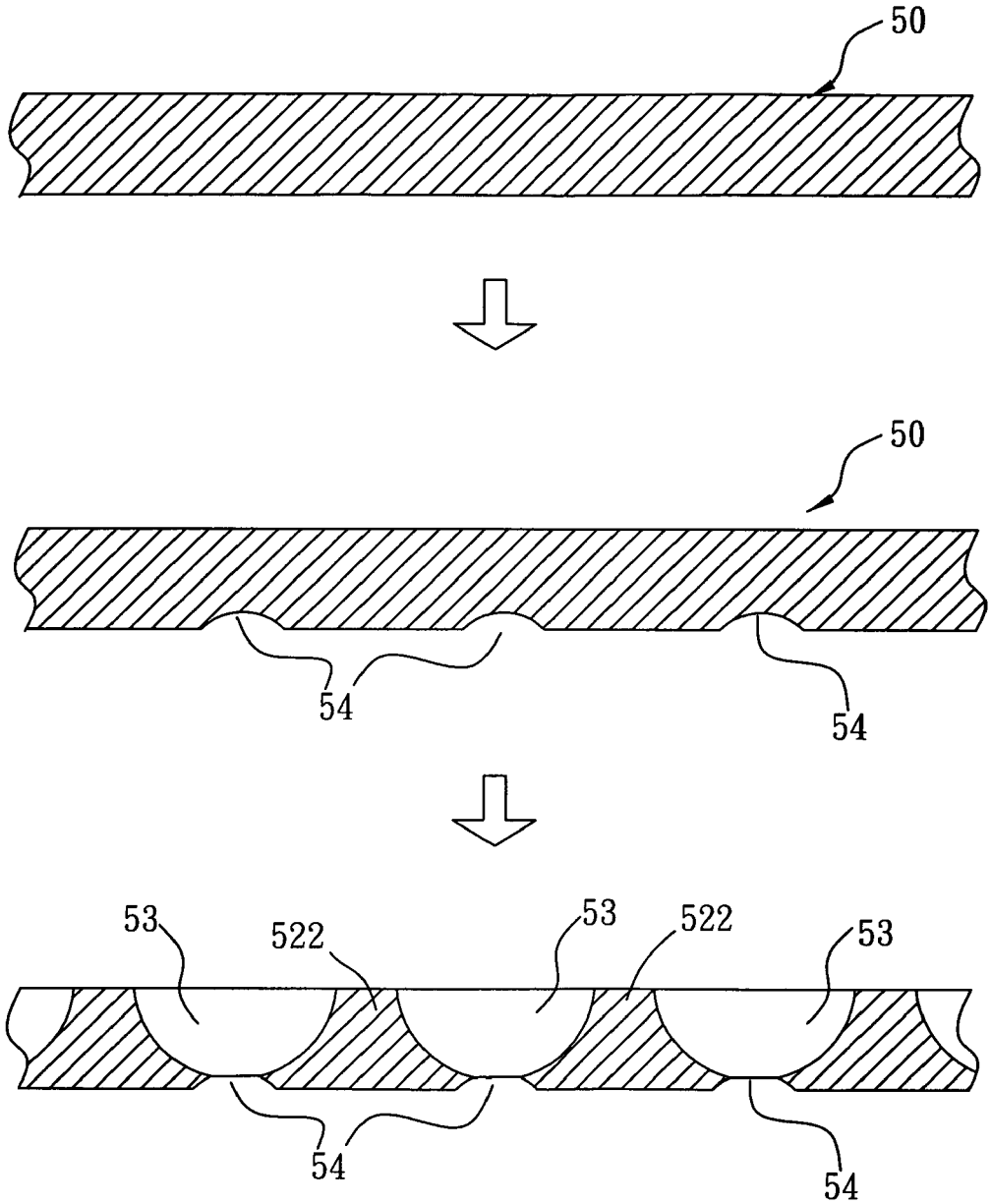
FIG. 7 is a schematic cross-sectional view of the change of a portion of a shadow mask according to another machining process of the present invention.

The present invention relates to a method of making a shadow mask for an opposite discharge plasma display panel. The shadow mask is a thin metal slab 40 as shown in FIG. 6 before the shadow mask is manufactured, and both lateral surfaces of the metal slab 40 are flat and even. The method of the present invention adopts an etching process to etch a plurality of parallel and equidistant barrier ribs 422 along the vertical direction and horizontal direction on a lateral surface of the metal slab 40, wherein a space is formed by enclosing every four adjacent barrier ribs 422 to produce a discharging cell 43 of the opposite discharge plasma display panel, and a shadow hole 41 is etched at the middle of each discharging cell 43 and penetrated through the metal slab 40. A groove 44 is produced on another lateral surface of the metal slab 40 and at a position corresponding to the shadow hole 41 of each discharging cell 43 by a machining process instead of a traditional etching process, and the adjacent grooves 44 are interconnected with each other to form a plurality of air guide channels on the other lateral surface. In FIG. 7, the method of the invention also can select another lateral surface of the metal slab 50 for producing a plurality of grooves 54 disposed at the positions corresponding to the discharging cells 43 by a machining process, and the adjacent grooves 54 are interconnected to each other to form a plurality of air guide channels on the other lateral surface. A plurality of parallel and equidistant barrier ribs 522 is etched along the vertical direction and horizontal direction on a lateral surface of the metal slab 50, wherein a space is formed by enclosing every four adjacent barrier ribs 522 to produce a discharging cell 53 of the opposite discharge plasma display panel, and the middle of each discharging cell 53 is penetrated through the metal slab 50 and interconnected with the groove 54.

Figure 8:
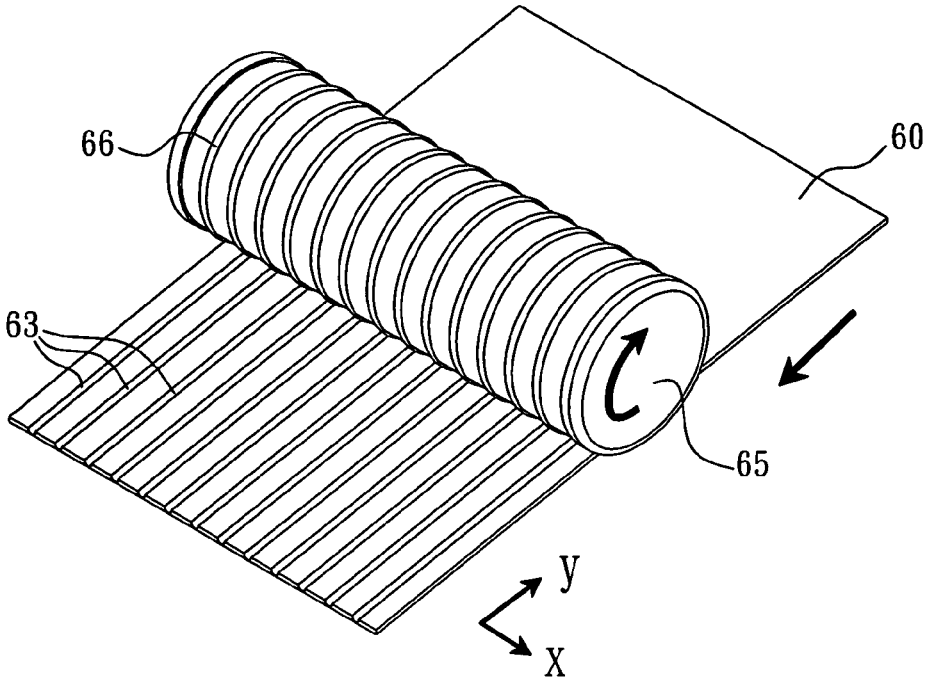
FIG. 8 is a schematic view of a preferred embodiment of the present invention.

Referring to FIG. 8 for the method according to a preferred embodiment of the present invention, a roller 65 is used to roll another lateral surface of the shadow mask and carry out a machining process, and the roller 65 includes a plurality of parallel and equidistant circular protruding ribs 66 disposed along the direction of its central axis. The roller 65 rolls along the vertical direction (which is the y-axis direction) on a thin metal slab 60 to produce a plurality of grooves along the vertical direction on the metal slab 60 and a plurality of air guide channels 63 on another lateral surface. As described above, the air guide channels 63 must be designed at a position corresponding to each discharging cell 43 of the shadow mask and interconnected with each corresponding shadow hole 41.

Figure 9:
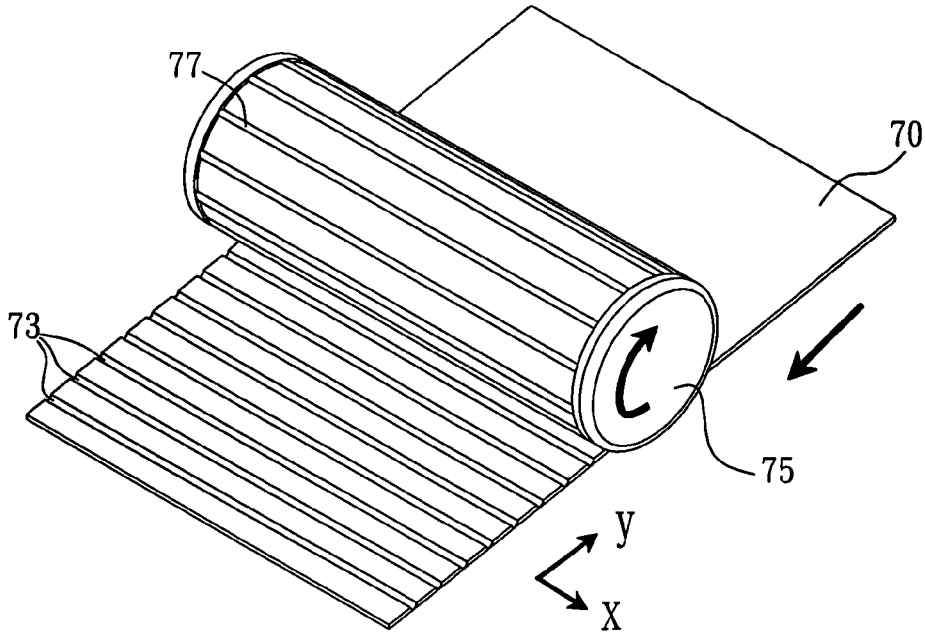
FIG. 9 is a schematic view of another preferred embodiment of the present invention.

Referring to FIG. 9 for the method according to another preferred embodiment of the present invention, the method uses a roller 75 to roll another lateral surface of the shadow mask, and the roller 75 includes a plurality of linear protruding ribs 77 parallel to its central axis, and the linear protruding ribs 77 are parallel and equidistant with each other. The roller 75 rolls along the vertical direction (which is the y-axis direction) on a thin metal slab 70 to produce a plurality of grooves disposed along the horizontal direction (which is the x-axis direction) of the metal slab 70 and a plurality of air guide channels 73 on another lateral surface. The air guide channel 73 must be designed at a position corresponding to each discharging cell 43 of the shadow mask and interconnected to the shadow hole 41.

Figure 10:
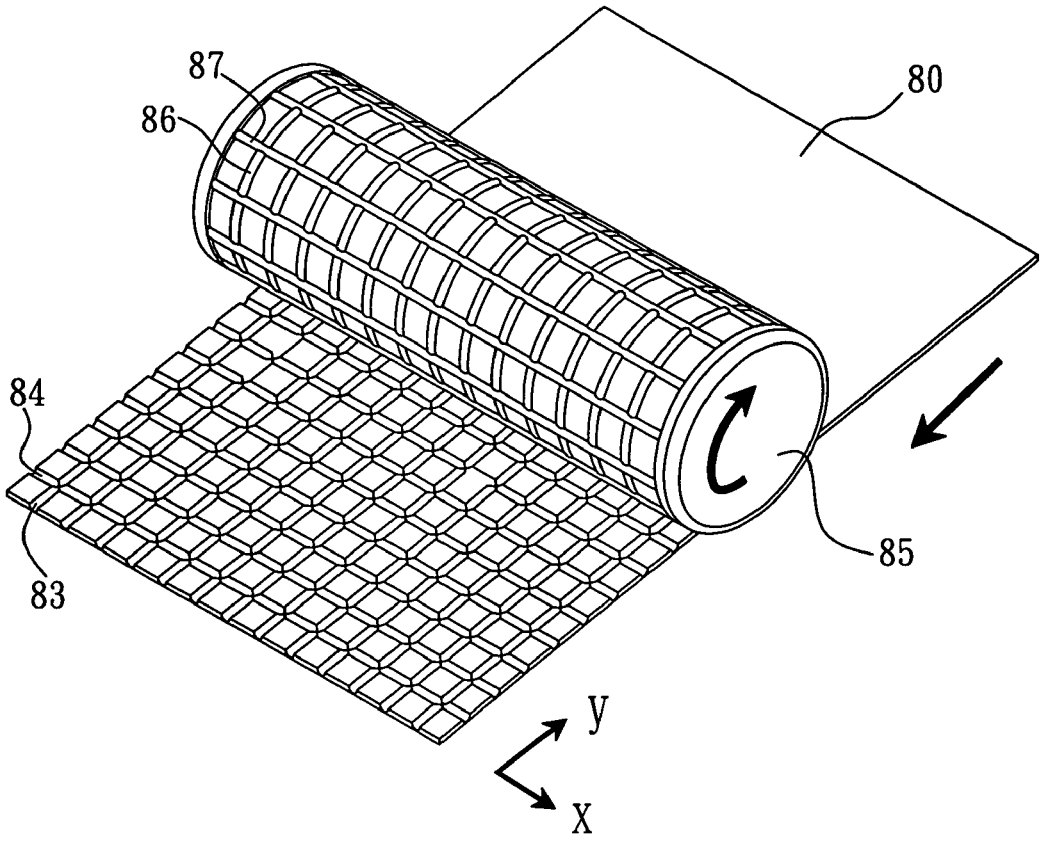
FIG. 10 is a schematic view of a further preferred embodiment of the present invention.

Referring to FIG. 10 for the method according to another further preferred embodiment of the present invention, the method uses a roller 85 to roll another lateral surface of the shadow mask, and the roller 85 includes a plurality of parallel and equidistant circular protruding ribs 86 disposed along its central axis and a plurality of linear protruding rib 87 parallel to its central axis, and the linear protruding ribs 87 are parallel and equidistant with each other, such that the roller 85 rolls along the vertical direction (which is the y-axis direction) on a thin metal slab 80 to produce a plurality of grooves along the vertical direction (which is the y-axis direction) and the horizontal direction (which is the x-axis direction) on the metal slab 80 and a plurality of air guide channels 83, 84 along the vertical direction and the horizontal direction on another lateral surface. The air guide channel 83, 84 must be designed at a position corresponding to each discharging cell 43 of the shadow mask and interconnected with the shadow hole 41.

It is worth pointing out that the foregoing embodiments are some of the preferred embodiments of the present invention, but the actual practice of the invention is not limited to these preferred embodiments only. The people skilled in the art can base on the principle of the invention to produce the required barrier ribs, discharging cells, and shadow holes on a lateral side of the shadow mask by using a single-sided etching process, and adopts a machining process such as a rolling process (by using a roller) or a stamping process (by using a mold) to produce a groove interconnected to the shadow hole and disposed along a horizontal direction, vertical direction, aslant direction, and two-dimensional interlacing direction on another lateral surface of the shadow mask and at a position corresponding to each discharging cell, such that the adjacent grooves are interconnected with each other to produce a plurality of air guide channels. Such arrangement is intended to be covered by the scope of the claims of the present invention.

In summation of the description above, the manufacturing process of the present invention can produce a shadow mask for the opposite discharge plasma display panel in a simple and fast manner and use the machining process to accurately control the width and depth of the air channel. The invention not only reduces the chemical pollution problem caused by the traditional double-sided etching and greatly improves the efficiency of discharging and filling the air for the discharging cell and lowers the production cost of the shadow mask, but also increases the etching depth of the discharging cell and the coating area of the phosphor, so as to effectively enhance the luminescence efficiency and yield rate of the opposite discharge plasma display panel.

While the invention herein disclosed has been described by means of specific embodiments, numerous modifications and variations could be made thereto by those skilled in the art without departing from the scope and spirit of the invention set forth in the claims.

What is claimed is:

1. A method for making a shadow mask for an opposite discharge plasma display panel, comprising:

etching a plurality of parallel and equidistant barrier ribs along the vertical and horizontal directions of a lateral surface of a metal slab by an etching process, wherein a space enclosed by every four adjacent barrier ribs defines a discharging cell of said opposite discharge plasma display panel and a shadow hole being etched and formed at the middle of said each discharging cell penetrates said metal slab; and producing a groove interconnected with said shadow holes and disposed on another lateral surface of said metal slab corresponding to the position of said each discharging cell by a mechanical machining process, and the adjacent grooves being interconnected with each other to form a plurality of air guide channels on another lateral side of said metal slab.

2. The method of claim 1, wherein said mechanical machining process is a stamping process that uses a mold to stamp said metal slab to produce said air guide channels.

3. The method of claim 1, wherein said mechanical machining process is a rolling process that rolls on said metal slab to produce said air guide channels.

4. The method of claim 3, wherein said rolling process uses a roller to roll on another lateral surface of said shadow mask, and said roller includes a plurality of linear protruding ribs disposed parallel to the central axis of said roller, and said linear protruding ribs are parallel and equidistant with each other.

5. The method of claim 3, wherein said rolling process uses a roller to roll on another lateral side of said shadow mask, and said roller along its axial direction includes a plurality of parallel and equidistant circular protruding ribs.

6. The method of claim 5, wherein said roller includes a plurality of linear protruding ribs disposed parallel to the central axis of said roller, and said linear protruding ribs are parallel and equidistant with each other.

* * * * *